US005786299A

United States Patent [19]

Lawrence et al.

[11] Patent Number: 5,786,299

[45] Date of Patent: Jul. 28, 1998

[54] THERMAL DYE TRANSFER ASSEMBLAGE WITH LOW TG POLYMERIC RECEIVER MIXTURE

[75] Inventors: Kristine B. Lawrence; Steven V. Haldeman; Teh-Ming Kung, all of Rochester, N.Y.

[73] Assignee: Eastman Kodak Company, Rochester, N.Y.

[21] Appl. No.: 878,565

[22] Filed: Jun. 19, 1997

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS

| | | | |
|---|---|---|---|
| 5,523,274 | 6/1996 | Shuttleworth et al. | 503/227 |
| 5,534,479 | 7/1996 | Shuttleworth et al. | 503/227 |
| 5,627,128 | 5/1997 | Bowman et al. | 503/227 |

FOREIGN PATENT DOCUMENTS

| | | | |
|---|---|---|---|
| 5/238174 | 9/1993 | Japan | 503/227 |

*Primary Examiner*—Bruce H. Hess
*Attorney, Agent, or Firm*—Harold E. Cole

[57] ABSTRACT

A thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N-H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) a polymer having a Tg of less than about 19° C. and having no or only slight acidity; and b) a water-soluble, multifunctional carboxylic acid with at least two carboxylic acid groups attached.

12 Claims, No Drawings

THERMAL DYE TRANSFER ASSEMBLAGE WITH LOW TG POLYMERIC RECEIVER MIXTURE

CROSS REFERENCE TO RELATED APPLICATIONS

Reference is made to commonly-assigned U.S. patent application Ser. Nos. 08/878,924, filed concurrently herewith, entitled "Assemblage for Thermal Dye Transfer" by Bowman et al; 08/878,717, filed concurrently herewith, entitled "Thermal Dye Transfer Assemblage With Low Tg Polymeric Receiver Mixture" by Harrison et al 08/878,951, filed concurrently herewith, entitled "Thermal Dye Transfer Assemblage With Low Tg Polymeric Receiver Mixture" by Kung et al; 08/879,061, filed concurrently herewith, entitled "Assemblage for Thermal Dye Transfer" by Guistina et al; and 08/878,564, filed concurrently herewith, entitled "Thermal Dye Transfer Assemblage" by Evans et al; the teachings of which are incorporated herein by reference.

FIELD OF THE INVENTION

This invention relates to a thermal dye transfer receiver element of a thermal dye transfer assemblage and, more particularly, to a polymeric dye image-receiving layer containing a mixture of materials capable of reprotonating a deprotonated cationic dye transferred to the receiver from a suitable donor.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

In one type of thermal dye transfer printing, deprotonated nonionic dyes may be transferred to an acid-containing receiver where a reprotonation process may take place to convert the dyes to their protonated form by interaction with the acid moiety in the dye-receiving layer. The dyes are thus rendered cationic. As a consequence, the transferred dyes are anchored in the receiving layer and form a strong electrostatic bond. The reprotonation reaction also causes a hue shift of the transferred dyes from their deprotonated form to their protonated form. In a practical sense, it is always desirable to complete this protonation process as fast as possible at a rate known as the dye conversion rate.

DESCRIPTION OF RELATED ART

U.S. Pat. No. 5,523,274 relates to the transfer of a deprotonated cationic dye to a dye image-receiving layer containing an organic acid moiety as part of an acrylic ester polymer chain having a Tg of less than 25° C. which is capable of reprotonating the deprotonated cationic dye. There is no disclosure in this patent that describes the use of mixtures comprising a multifunctional carboxylic acid capable of reprotonating the deprotonated cationic dye and a polymer having no or only slight acidity.

U.S. Pat. No. 5,534,479 relates to the transfer of a deprotonated cationic dye to a dye image-receiving layer containing an organic acid moiety as part of a polymer which is capable of reprotonating the deprotonated cationic dye. In addition, this patent also discloses the use of a solvent-soluble organic acid in the receiving layer. However, there is a problem with using a solvent-soluble organic acid in a dye-receiving element in that such solvents are not compatible with aqueous-coatable systems and are environmentally-unfriendly.

U.S. Pat. No. 5,627,128 relates to the transfer of a deprotonated cationic dye to a polymeric dye image-receiving layer comprising a mixture of an organic polymeric or oligomeric acid which is capable of reprotonating the deprotonated cationic dye and a polymer having a Tg of less than about 19° C. and having no or only slight acidity. There is a problem with this polymer mixture in that the rate of reprotonation of the deprotonated cationic dyes is not as fast as one would like it to be.

JP 05/238174 describes the thermal transfer of pendant basic-substituted dyes to a receiver element containing acidic materials. The common basic substituents disclosed are amines and the preferred acidic materials are relatively weak acids such as carboxylic acids or phenols, which are not water-soluble. However, there is a problem with using these weakly acidic materials in that they are unable to rapidly and completely protonate deprotonated cationic dyes. Also, these receiver elements do not totally inhibit subsequent migration of the basic dyes to other surfaces.

It is an object of this invention to provide a thermal dye transfer assemblage which will reprotonate a deprotonated cationic dye transferred to the receiver of the assemblage. It is another object of the invention to provide a thermal dye transfer assemblage which has a receiver with an improved dye conversion rate.

SUMMARY OF THE INVENTION

These and other objects are achieved in accordance with this invention which relates to a thermal dye transfer assemblage comprising:

(I) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (II) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of a) a polymer having a Tg of less than about 19° C. and having no or only slight acidity; and b) a water-soluble, multifunctional carboxylic acid with at least two carboxylic acid groups attached.

DESCRIPTION OF THE PREFERRED EMBODIMENTS

It was found that the addition of a water-soluble, multifunctional carboxylic acid to an acid-containing receiver for reprotonation of a deprotonated nonionic dye substantially improves the dye conversion rate in comparison with receivers not containing such addendum.

The polymer having a Tg of less than about 19° C. employed in the invention may contain groups which are slightly acidic to improve water dispersibility. However, these acid groups are generally insufficient to protonate the dye.

Deprotonated cationic dyes useful in the invention which are capable of being reprotonated to a cationic dye having a N—H group which is part of a conjugated system are described in U.S. Pat. No. 5,523,274, the disclosure of which is hereby incorporated by reference.

In a preferred embodiment of the invention, the deprotonated cationic dye employed in the invention and the corresponding cationic dye having a N—H group which is part of a conjugated system have the following structures:

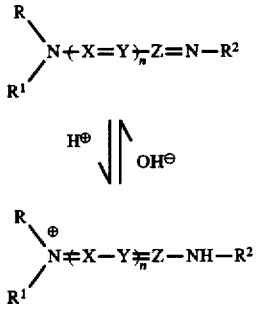

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents a substituted or unsubstituted phenyl or naphthyl group or a substituted or unsubstituted alkyl group from about 1 to about 10 carbon atoms; and n is an integer of from 0 to 11.

The deprotonated cationic dyes according to the above formula are disclosed in U.S. Pat. Nos. 4,880,769, 4,137,042 and 5,559,076, and in K. Venkataraman ed., *The Chemistry of Synthetic Dyes*, Vol. IV, p. 161, Academic Press, 1971, the disclosures of which are hereby incorporated by reference. Specific examples of such dyes include the following (the λ max values and color descriptions in parentheses refer to the dye in its protonated form):

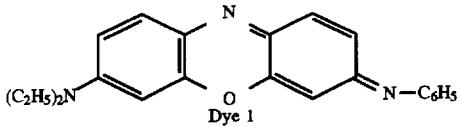

Dye 1
λ max 556 nm (641 nm)
magenta (cyan)
U.S. Pat. No. 4,880,769 (Dye 1)

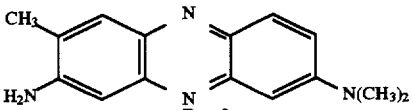

Dye 2
λ max 459 nm (536 nm)
yellow (magenta)

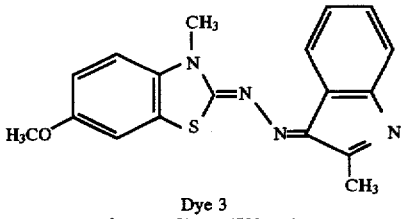

Dye 3
λ max 459 nm (522 nm)
yellow (magenta)

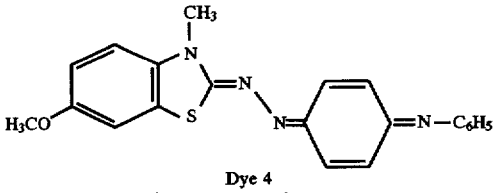

Dye 4
λ max 503 nm (621 nm)
red (blue)

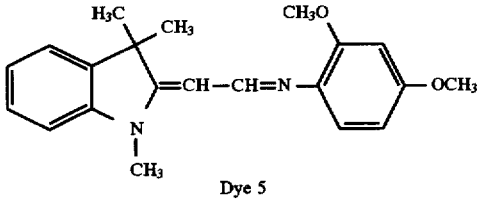

Dye 5
λ max 379 nm (405 nm)
yellow (yellow)

-continued

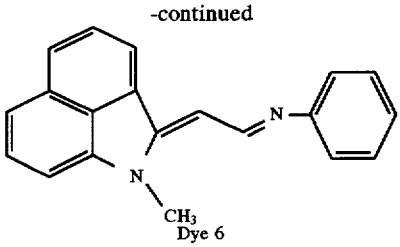

Dye 6
λmax 479 nm (513 nm)
yellow (magenta)

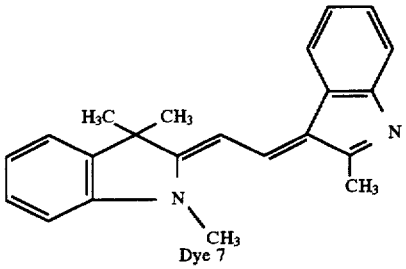

Dye 7
λmax 485 nm (495)
yellow (yellow)

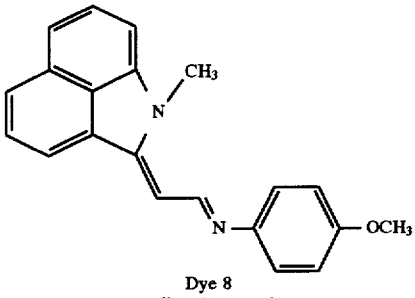

Dye 8
yellow (magenta)
U.S. Pat. No. 5,559,076 (dye precursor 5)

The dyes described above may be employed in any amount effective for the intended purpose. In general, good results have been obtained when the dye is present in an amount of from about 0.05 to about 1.0 g/m$^2$, preferably from about 0.1 to about 0.5 g/m$^2$. Dye mixtures may also be used.

Any type of polymer may be employed in the receiver of the invention, e.g., condensation polymers such as polyesters, polyurethanes, polycarbonates, etc.; addition polymers such as polystyrenes, vinyl polymers, acrylic polymers, etc.; block copolymers containing large segments of more than one type of polymer covalently linked together; or blends thereof, provided such polymeric material has the low Tg as described above. In a preferred embodiment of the invention, the dye image-receiving layer comprises an acrylic polymer, a styrene polymer or a vinyl polymer. These polymers may be employed at a concentration of from about 0.05 g/m$^2$ to about 20 g/m$^2$.

Following are examples of low Tg polymers that may be used in the invention:

Polymer P-1: poly(butyl acrylate-co-allyl methacrylate) 98:2 wt core/poly(glycidyl methacrylate) 10 wt shell, (Tg=−40° C.)

Polymer P-2: poly(butyl acrylate-co-allyl methacrylate) 98:2 wt core/poly(ethyl methacrylate) 30 wt shell, (Tg=−41° C.)

Polymer P-3: poly(butyl acrylate-co-allyl methacrylate) 98:2 wt core/poly(2-hydroxypropyl methacrylate) 10 wt shell, (Tg=−40° C.)

Polymer P-4: poly(butyl acrylate-co-ethylene glycol dimethacrylate) 98:2 wt core/poly(glycidyl methacrylate 10 wt shell, Tg=−42° C.)

Polymer P-5: poly(butyl acrylate-co-allyl methacrylate-co-glycidyl methacrylate) 89:2:9 wt, (Tg=−34° C.)

Polymer P-6: poly(butyl acrylate-co-ethylene glycol dimethacrylate-co-glycidyl methacrylate) 89:2:9 wt (Tg=−28° C.)

Polymer P-7: poly(butyl methacrylate-co-butyl acrylate-co-allyl methacrylate) 49:49:2 wt core/poly(glycidyl methacrylate) 10 wt shell, (Tg=−18° C.)

Polymer P-8: poly(methyl methacrylate-co-butyl acrylate-co-2-hydroxyethyl methacrylate-co-2-sulfoethyl methacrylate sodium salt) 30:50:10:10 wt, (Tg=−3° C.)

Polymer P-9: poly(methyl methacrylate-co-butyl acrylate-co-2-hydroxyethyl methacrylate-co-styrenesulfonic acid sodium salt) 40:40:10:10 wt, (Tg=0° C.)

Polymer P-10: poly(methyl methacrylate-co-butyl acrylate-co-2-sulfoethyl methacrylate sodium salt-co-ethylene glycol dimethacrylate) 44:44:10:2 wt, (Tg=14° C.)

Polymer P-11: poly(butyl acrylate-co-Zonyl TM®-co-2-acrylamido-2-methyl-propanesulfonic acid sodium salt) 50:45:5 wt (Tg=−39° C.) (Zonyl TM® is a monomer from the DuPont Company)

Polymer P-12: XU31066.50 (experimental polymer based on a styrene butadiene copolymer from Dow Chemical Company) (Tg=−31° C.)

Polymer P-13: AC540® nonionic emulsion (Allied Signal Co.) (Tg=−55° C.)

The polymer in the dye image-receiving layer may be present in any amount which is effective for its intended purpose. In general, good results have been obtained at a concentration of from about 0.5 to about 20 g/m$^2$. The polymers may be coated from organic solvents or water, if desired.

The water-soluble, multifunctional carboxylic acid employed in the invention may be aliphatic, alicyclic or aromatic. In a preferred embodiment, the multifunctional carboxylic acid is succinic acid. The water-soluble, multifunctional carboxylic acid employed in the invention may be employed in any amount effective for the intended purpose. In general, good results have been obtained when the water-soluble, multifunctional carboxylic acid is present in an amount of from about 0.02 to about 5.0 g/m$^2$, preferably from about 0.2 to about 1.0 g/m$^2$.

Specific examples of water-soluble, multifunctional carboxylic acids useful in the invention include the following:

A-1 succinic acid, MW = 118.09 (Acros Chemical)
$HOOC-(CH_2)_2-COOH$

A-2 oxalic acid, MW = 90.03 (Eastman Fine Chemicals)
$HOOC-COOH$

A-3 malonic acid, MW = 104.06 (Fisher Chemicals)
$HOOC-CH_2-COOH$

A-4 tricarballylic acid, MW = 176.12 (Aldrich Chemical Co.)

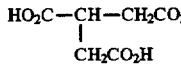

A-5 citric acid, MW = 192.13 (Aldrich Chemical Co.)

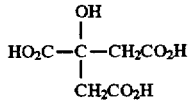

A-6 tetrahydrofurantetracarboxylic acid (Aldrich Chemical Co.)
MW = 248.15

-continued

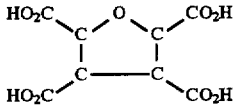

A-7 5-sulfoisophthalic acid, sodium salt, (Aldrich Chemical Company)
A-8 poly(acrylic acid), Tg = 105° C.
A-9 glutaric acid, MW = 132.12, Eastman Fine Chemicals
A-10 adipic acid, MW = 146.16, Eastman Fine Chemicals
A-11 maleic acid, MW = 116.07, Eastman Fine Chemicals
A-12 1,1,2-dodecanetricarboxylic acid, MW = 302.4
A-13 dodecylpropanedioic acid, MW = 272.4
A-14 2-(phenylmethyl)-dodecylpropanedioic acid, MW = 362.5
A-15 trans-aconitic acid, MW = 174.1

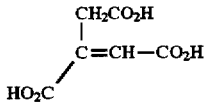

A-16 1,2,4-benzenetricarboxylic acid, MW = 210.14, Aldrich Chemical Co.

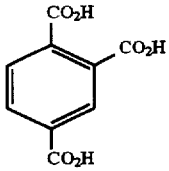

A-17 1,2,4,5-benzenetetracarboxylic acid, MW = 254.15, Aldrich Chemical Co.

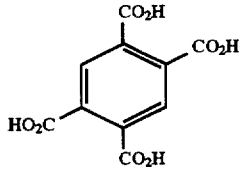

The support for the dye-receiving element employed in the invention may be transparent or reflective, and may comprise a polymeric, synthetic or cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Any material can be used as the support for the dye-donor element employed in the invention, provided it is dimensionally stable and can withstand the heat of the thermal print heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FIP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal print head. After the first dye is transferred, the elements are peeled apart. A second dye-donor element (or another area of the donor element with a different dye area) is then brought into register with the dye-receiving element and the process repeated. The third color is obtained in the same manner. After thermal dye transfer, the dye image-receiving layer contains a thermally-transferred dye image.

The following examples are provided to further illustrate the invention.

EXAMPLES

Example 1

Dye-Donor Elements

Individual dye-donor elements were prepared by coating the following compositions in the order listed on a 6 μm poly(ethylene terephthalate) support:

1) a subbing layer of Tyzor TBT®, a titanium tetrabutoxide, (DuPont Company) (0.16 g/m$^2$) coated from 1-butanol/propyl acetate (15/85 wt. %); and 2) an imaging dye layer coated from a tetrahydrofuran/cylopentanone (95/5) solvent mixture, whereby two different binder polymer mixtures with the selected dye as shown in Table 1 were used:

DB-1 propionate ester of bisphenol A copolymer with epichlorohydrin (prepared by techniques similar to those described in U.S. Pat. No. 5,244,862);

DB-2 poly(butyl methacrylate-co-Zonyl TM®) (75/25) where Zonyl TM® is a perfluoro monomer available from DuPont.

Details of dye and binder laydowns are summarized in the following Table 1:

TABLE 1

| Dye-Donor Element | Deprotonated Dye | Dye Laydown, (g/m$^2$) | DB-1 Laydown, (g/m$^2$) | DB-2 Laydown, (g/m$^2$) |
|---|---|---|---|---|
| Yellow | Dye 5 | 0.28 | 0.27 | 0.07 |
| Cyan | Dye 1 | 0.15 | 0.18 | 0.05 |

On the back side of the dye-donor element were coated the following compositions in the order listed:

1) a subbing layer of Tyzor TBT®, a titanium tetrabutoxide, (DuPont Company) (0.13 g/m$^2$) coated from 1-butanol/propyl acetate (15/85 wt. %); and 2) a slipping layer of 0.38 g/m$^2$ poly(vinyl acetal) (Sekisui), 0.022 g/m$^2$ Candelilla wax dispersion (7% in methanol), 0.011 g/m$^2$ PS513 amino-terminated polydimethylsiloxane (Huels) and 0.0003 g/m$^2$ p-toluenesulfonic acid coated from a 3-pentanone/distilled water (98/2) solvent mixture.

Dye-Receivers Elements

Control Receiver Element C-1:

This element was prepared by first extrusion laminating a paper core with a 38 μm thick microvoided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221, aminopropyltriethoxysilane, (0.05 g/m$^2$) and Prosil® 2210, an aminofunctional epoxysilane, (0.05 g/m$^2$) (both available from PCR, Inc.) coated from 3A alcohol; and 2) a dye-receiving layer of a mixture 6.73 g/m$^2$ of polymer P-1, and 0.022 g/m$^2$ of a fluorocarbon surfactant (Fluorad FC-170C®, 3M Corporation).

Control Receiver Element C-2:

This element was prepared as described above for Control Receiver Element C-1 except that the dye-receiving layer was composed of a mixture of 2.69 g/m$^2$ of control acid source CA-1 (see below), and 4.04 g/m$^2$ of polymer P-1, and 0.022 g/m$^2$ of a fluorocarbon surfactant (Fluorad FC-170C®, 3M Corporation). This composition was analogous to Receiver Elements 7 through 18 in Example 1 of U.S. Pat. No. 5,627,128.

Control Acid Sources:

CA-1: poly[isophthalic acid-co-5-sulfoisophthalic acid (90:10 molar ratio)-diethylene glycol (100 molar ratio)], Mw=20,000 (sulfonic acid of AQ29, Eastman Chemical Co., acidic substance A-1 of U.S. Pat. No. 5,627,128)

CA-2: trichlorophenol (acidic substance I-12 of JP 05-238174)

CA-3: hexanoic acid, (Eastman Chemical Company)

CA-4: 5-sulfosalicyclic acid, dihydrate, (Eastman Chemical Company)

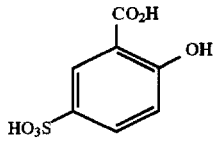

CA-5: 1,5-naphthalenedisulfonic acid, hexahydrate, (Aldrich Chemical Company)

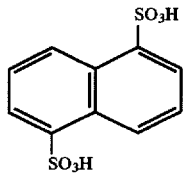

Receiver Elements 1 through 4 of the Invention:

These elements were prepared as described above for Control Receiver Element C-1 except that the dye-receiving layer was composed of a mixture of Acid Source A-1 and Polymer P-1 and 0.022 g/m$^2$ of a fluorocarbon surfactant (Fluorad FC-170C®, 3M Corporation) coated from distilled water. The level of A-1 was varied from 0.22 g/m$^2$ to 0.65 g/m$^2$, keeping the final dry laydown constant at 6.73 g/m$^2$. The dry laydowns for A-1 and P-1 are summarized in Table 2.

TABLE 2

| Receiver Element | Acid Source A-1 (g/m$^2$) | Polymer P-1 (g/m$^2$) |
|---|---|---|
| 1 | 0.22 | 6.51 |
| 2 | 0.32 | 6.41 |
| 3 | 0.43 | 6.30 |
| 4 | 0.65 | 6.08 |

Preparation and Evaluation of Thermal Dye Transfer Images

Eleven-step sensitometric thermal dye transfer images were prepared from the above dye-donor elements and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head TDK model no. L-231, resolution of 5.4 dots/mm, thermostated at 25° C. was pressed with a force of 24.4 Newton (2.5 kg) against the dye-donor element side of the assemblage, pushing it against the rubber roller.

The imaging electronics were activated causing the donor-receiver assemblage to be drawn through the print head/roller nip at 40.3 mm/sec. Coincidentally, the resistive elements in the thermal print head were pulsed for 127.75 μs/pulse at 130.75 μs intervals during a 4.575 msec/dot printing cycle (including a 0.391 msec/dot cool-down interval). A stepped image density was generated by incrementally increasing the number of pulses/dot from a minimum of 0 to a maximum of 32 pulses/dot. The voltage supplied to the thermal head was approximately 13.0 volts resulting in an instantaneous peak power of 0.318 watts/dot and a maximum total energy of 1.30 mJ/dot. This procedure was done using the yellow dye-donor element and then repeated on a portion of the yellow image with the cyan dye-donor element to produce a green stepped image. Print room humidity: 35% RH.

For images containing a cyan dye (cyan or green images), protonation causes a color change from the deprotonated dye form (magenta) to the protonated dye form (cyan). This color change can be monitored by measuring Status A red (cyan) and green (magenta) densities and calculating a red/green ratio as a function of time.

After printing, the dye-donor element was separated from the imaged receiving element and the Status A reflection red and green densities at step 10 in the stepped-image were measured for the green image using an X-Rite 820® reflection densitometer after 5 minutes at room temperature. The prints were then placed into a 50° C./50% RH oven for 3 hours and the red and green densities were reread. A red/green (R/G) ratio (minus the baseline) was calculated for the green image in each receiver at the above mentioned time intervals and the % dye conversion for the cyan dye in the green image was calculated assuming the incubated R/G ratios represented 100% dye conversion. The results are summarized in Table 3 below.

TABLE 3

| Receiver Element | R/G Ratio 5 Min. r.t.[1] | R/G Ratio 3 Hours inc.[2] | % Dye Conv. 5 Min.[3] |
|---|---|---|---|
| 1 | 3.88 | 4.58 | 85% |
| 2 | 3.90 | 4.72 | 83% |
| 3 | 3.64 | 4.42 | 82% |
| 4 | 3.13 | 4.21 | 74% |
| C-1[4] | 0.17 | 0.28 | — |
| C-2 | 2.02 | 5.78 | 35% |

[1]calculated red/green ratio for green image after 5 minutes at room temperature
[2]calculated red/green ratio for green image after 3 Hours at 50° C./50% RH
[3](R/G Ratio, 5 min. r.t.)/(R/G Ratio, 3 Hrs., inc.) × 100 for green image
[4]transferred dyes were not reprotonated; and the transferred image remained magenta in color.

The results in Table 3 show that mixing a water-soluble, multifunctional carboxylic acid with a polymer having a Tg less than 19° C. and being of no or only slight acidity (Receiver Elements 1–4) improved the rate of protonation (dye conversion) of deprotonated cationic dyes after printing relative to the control receiver elements containing no acid (C-1) or containing a mixture of a polymeric sulfonic acid or and a polymer having a Tg less than 19° C. and being of no or only slight acidity (C-2).

Example 2

The dye-donor elements used were analogous to those described in Example 1 above.

Dye-Receiver Elements

Control Receiver Element C-3:

This element was prepared similar to Control Receiver Element C-1 of Example 1, except the dye-receiving layer was coated on a subbing layer of 0.02 g/m$^2$ Polymin® polyethyleneimine (BASF Corporation) coated from distilled water. In addition, the dye-receiving layer was composed of a mixture of 7.23 g/m$^2$ of Vylon® 200 Toyobo Co., Ltd. (similar to Vylon® 280 described in JP 05-238174), 0.72 g/m$^2$ of CA-2 (trichlorophenol) and 0.66 g/m$^2$ polyisocyanate (Desmodour N330®, Mobay Corp.) coated from a toluene/2-butanone/cyclohexanone solvent mixture (46/46/8). This element is essentially identical to Example 1 of JP 05-238174.

Receiver Elements 5 through 11 and Control Receiver Elements C-4 Through C-6:

These elements were prepared as described above for Control Receiver Element C-1, except the dye-receiving layers were composed of mixtures of A-2 through A-8, CA-3 through CA-5 and Polymer P-1. The dry laydowns (g/m$^2$) for A-2 through A-8 and CA-3 through CA-5 were chosen to provide levels of acidity equivalent to A-1 in Receiver Element 2 of Example 1. The total dry laydown of the mixture was kept constant at 6.73 g/m$^2$. The meq/gm of each acid and dry laydowns for A-1 through A-8 and CA-3 through CA-5 and dry laydowns for P-1 are summarized in Table 4.

TABLE 4

| Receiver Element | Acid Source | meq/g of Acid Source (calc.)[1] | Laydown of Acid Source (g/m$^2$) | Laydown of Polymer P-1 (g/m$^2$) |
|---|---|---|---|---|
| 2 | A-1 | 8.5 | 0.32 | 6.41 |
| 5 | A-2 | 11.1 | 0.25 | 6.48 |
| 6 | A-3 | 9.6 | 0.29 | 6.44 |
| 7 | A-4 | 5.7 | 0.48 | 6.25 |
| 8 | A-5 | 5.2 | 0.53 | 6.20 |
| 9 | A-6 | 4.0 | 0.69 | 6.04 |
| 10 | A-7 | 3.7 | 0.74 | 5.99 |
| 11 | A-8 | 13.9 | 0.19 | 6.53 |
| C-4 | CA-3 | 8.6 | 0.32 | 6.41 |
| C-5 | CA-4 | 3.9 | 0.70 | 6.03 |
| C-6 | CA-5 | 2.8 | 0.98 | 5.75 |

[1]milliequivalents of titratable protons per gram of material (l/mw × 1000)

Thermal dye transfer prints were prepared and evaluated as described in Example 1, except the print room humidity was 46% RH; the results are summarized in Table 5 below.

TABLE 5

| Receiver Element | Acid Source | R/G Ratio, 5 Min. r.t.[1] | R/G Ratio, 3 Hours inc.[2] | % Dye Conv., 5 Min[3] |
|---|---|---|---|---|
| 2 | A-1 | 3.88 | 4.36 | 89% |
| 5 | A-2 | 3.40 | 3.65 | 93% |
| 6 | A-3 | 3.37 | 4.19 | 80% |
| 7 | A-4 | 3.85 | 4.24 | 91% |
| 8 | A-5 | 3.71 | 4.03 | 92% |
| 9 | A-6 | 3.29 | 3.80 | 87% |
| 10 | A-7 | 3.77 | 4.48 | 84% |
| 11 | A-8 | 3.74 | 4.50 | 83% |
| C-2 | CA-1 | 2.62 | 5.42 | 48% |
| C-3[4] | CA-2 | 0.27 | 0.38 | — |
| C-4[4] | CA-3 | 0.18 | 0.30 | — |
| C-5[5] | CA-4 | 2.67 | 2.61 | — |
| C-6[6] | CA-5 | 2.71 | 2.14 | — |

[1]calculated red/green ratio for green image after 5 minutes at room temperature
[2]calculated red/green ratio for green image after 3 Hours at 50° C./50% RH
[3](R/G Ratio, 5 min. r.t.)/(R/G Ratio, 3 Hrs., inc.) × 100 for green image
[4]transferred dyes were not reprotonated; and the transferred image remained magenta in color
[5]very low print density was obtained; and severe donor receiver sticking occurred and no % dye conversion could be determined
[6]very low print density was obtained and no % dye conversion could be determined The above results show that mixing a water-soluble, multifunctional carboxylic acid having at least two carboxylic acid groups with a polymer having a Tg less 19° C. and being of no or only slight acidity (Receiver Elements 2 and 5–11) improved the rate of protonation (dye conversion) of deprotonated cationic dyes after printing relative to the control receiver element C-2 containing a mixture of a polymeric sulfonic acid and a polymer having a Tg less than 19° C. and being of no or slight acidity.

The receiver mixture containing trichlorophenol (C-3) was not a water-soluble, multifunctional carboxylic acid and did not reprotonate the deprotonated cationic dye. The receiver mixture containing a water-soluble, monofunctional carboxylic acid (C-4) did not reprotonate the deprotonated cationic dye. The print quality was found to be quite poor and a % dye conversion could not be determined for receiver mixtures containing sulfonic acid groups (C-5 and C-6).

The invention has been described in detail with particular reference to preferred embodiments thereof, but it will be understood that variations and modifications can be effected within the spirit and scope of the invention.

what is claimed is:

1. A thermal dye transfer assemblage comprising:

(I) a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and (II) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer comprising a mixture of a) a polymer having a Tg of less than about 19° C. and having no or only slight acidity; and b) a water-soluble, multifunctional carboxylic acid with at least two carboxylic acid groups attached.

2. The assemblage of claim 1 wherein said polymer having a Tg of less than about 19° C. is an acrylic polymer, a styrene polymer or a vinyl polymer.

3. The assemblage of claim 1 wherein said deprotonated cationic dye has the following formula:

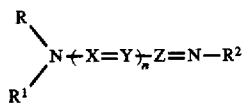

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

4. The assemblage of claim 1 wherein said water-soluble, multifunctional carboxylic acid is aliphatic, alicyclic or aromatic.

5. The assemblage of claim 1 wherein said water-soluble, multifunctional carboxylic acid is succinic acid.

6. The assemblage of claim 5 wherein said water-soluble, multifunctional carboxylic acid is present in an amount of from about 0.02 to about 5.0 g/m$^2$.

7. A process of forming a dye transfer image comprising imagewise-heating a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer, said polymeric dye image-receiving layer comprising a mixture of a) a polymer having a Tg of less than about 19° C. and having no or only slight acidity; and b) a water-soluble, multifunctional carboxylic acid with at least two carboxylic acid groups attached.

8. The process of claim 7 wherein said polymer having a Tg of less than about 19° C. is an acrylic polymer, a styrene polymer or a vinyl polymer.

9. The process of claim 7 wherein said deprotonated cationic dye has the following formula:

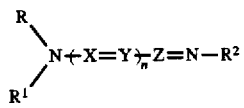

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

10. The process of claim 7 wherein said water-soluble, multifunctional carboxylic acid is aliphatic, alicyclic or aromatic.

11. The process of claim 7 wherein said water-soluble, multifunctional carboxylic acid is succinic acid.

12. The process of claim 11 wherein said water-soluble, multifunctional carboxylic acid is present in an amount of from about 0.02 to about 5.0 g/m$^2$.

* * * * *